US010767298B2

(12) United States Patent
Hombroek et al.

(10) Patent No.: US 10,767,298 B2
(45) **Date of Patent: *Sep. 8, 2020**

(54) STAIN REMOVAL TOOL FOR A LAUNDRY WASHING MACHINE

(71) Applicant: Midea Group Co., Ltd., Beijiao (CN)

(72) Inventors: Phillip C. Hombroek, Louisville, KY (US); Christopher G. Hoppe, Louisville, KY (US); Bryan T. Snook, Louisville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 271 days.

This patent is subject to a terminal disclaimer.

(21) Appl. No.: 15/356,258

(22) Filed: Nov. 18, 2016

(65) Prior Publication Data

US 2018/0142391 A1 May 24, 2018

(51) Int. Cl.

| | |
|---|---|
| ***D06F 29/00*** | (2006.01) |
| ***D06F 43/00*** | (2006.01) |
| ***D06F 5/00*** | (2006.01) |
| *A47L 25/00* | (2006.01) |

(52) U.S. Cl.

CPC ..... *D06F 29/00* (2013.01); *D06F 5/00* (2013.01); *D06F 43/002* (2013.01); *A47L 25/00* (2013.01)

(58) Field of Classification Search

CPC ..... D06F 29/00; D06F 43/002; A47L 25/00; A47L 25/08

USPC ..... 68/3 SS

See application file for complete search history.

(56) References Cited

U.S. PATENT DOCUMENTS

| | | | | |
|---|---|---|---|---|
| 2,254,691 | A | 9/1941 | MacLelland, Jr. | |
| 4,926,514 | A | 5/1990 | Leuenberger | |
| 5,402,657 | A | 4/1995 | Henry, Jr. | |
| 6,886,371 | B2 | 5/2005 | Arai et al. | |
| 7,225,502 | B2 | 6/2007 | Shenouda | |
| 7,313,932 | B2 | 1/2008 | Ryohke et al. | |
| 7,478,455 | B2 | 1/2009 | Heim | |
| 8,312,746 | B2 | 11/2012 | Perez-Toril Galan | |
| 8,549,887 | B2 | 10/2013 | Reid et al. | |
| 2002/0134117 | A1* | 9/2002 | Arai | D06F 19/00 68/3 SS |
| 2005/0072194 | A1 | 4/2005 | Ryohke et al. | |
| 2005/0284190 | A1 | 12/2005 | Fan et al. | |

(Continued)

FOREIGN PATENT DOCUMENTS

| | | | |
|---|---|---|---|
| CA | 2760131 | A1 | 6/2012 |
| CN | 1271791 | A1 | 11/2000 |

(Continued)

OTHER PUBLICATIONS

Machine translation of WO 9804771 A1, dated Feb. 1998. (Year: 1998).*

(Continued)

*Primary Examiner* — Joseph L. Perrin
*Assistant Examiner* — Kevin G Lee
(74) *Attorney, Agent, or Firm* — Middleton Reutlinger

(57) ABSTRACT

A stain removal tool for a laundry washing machine. The stain removal tool may be deployed from a stowed position and may be adapted to receive at least a portion of an article to substantially remove or treat a stain with water. The stain removal tool may have one or more nozzles upstream of the article.

14 Claims, 6 Drawing Sheets

(56) References Cited

U.S. PATENT DOCUMENTS

| | | | | |
|---|---|---|---|---|
| 2006/0156763 | A1* | 7/2006 | Vecchi | D06F 19/00 68/3 SS |
| 2008/0222817 | A1 | 9/2008 | Myhra et al. | |
| 2012/0084927 | A1 | 4/2012 | Levy | |
| 2016/0138207 | A1* | 5/2016 | Del Pos | D03F 39/02 68/17 R |

FOREIGN PATENT DOCUMENTS

| | | | | |
|---|---|---|---|---|
| CN | 1496426 | A | 5/2004 | |
| CN | 103306099 | A | 9/2013 | |
| CN | 203200532 | U | 9/2013 | |
| CN | 203462293 | U | 3/2014 | |
| CN | 204112094 | U | 1/2015 | |
| CN | 105256503 | A | 1/2016 | |
| DE | 202005008344 | U1 | 9/2005 | |
| EP | 2172587 | A2 | 4/2010 | |
| JP | H01223998 | A | 9/1989 | |
| JP | H01284294 | A | 11/1989 | |
| JP | 2000061192 | A | 2/2000 | |
| KR | 101254899 | B1 | 4/2013 | |
| KR | 20150071904 | A | 6/2015 | |
| SE | 1100383 | A1 | 1/2012 | |
| WO | WO-9706723 | A1 * | 2/1997 | A47L 25/08 |
| WO | WO9804771 | A1 | 2/1998 | |
| WO | 03018897 | A1 | 3/2003 | |
| WO | 2010072529 | A1 | 7/2010 | |
| WO | WO2011128745 | A2 | 10/2011 | |
| WO | 2014206485 | A1 | 12/2014 | |
| WO | 2015155787 | A2 | 10/2015 | |

OTHER PUBLICATIONS

Transmittal of Related Applications dated Aug. 8, 2018.
U.S. Patent and Trademark Office, Office Action issued in related U.S. Appl. No. 15/356,290 dated May 16, 2018.
International Search Report and Written Opinion issued in Application No. PCT/CN2017/102080 dated Nov. 14, 2017.
International Search Report and Written Opinion issued in Application No. PCT/CN2017/102131 dated Dec. 22, 2017.
Godrej, Godrej Eon U-Sonic Washing Machine-Detergent Mixer, https://www.youtube.com/watch?v=6B2MwBD1mCg, Oct. 29, 2013.
Black & Decker, Tide Buzz Ultrasonic Stain Remover, 2016.
U.S. Patent and Trademark Office, Final Office Action issued in related U.S. Appl. No. 15/356,290 dated Jan. 8, 2019.
U.S. Patent and Trademark Office, Office Action issued in related U.S. Appl. No. 15/356,290 dated Jul. 3, 2019.

* cited by examiner

STAIN REMOVAL TOOL FOR A LAUNDRY WASHING MACHINE

BACKGROUND

The present embodiments relate to a stain removal tool integrated into a laundry washing machine.

Typical stain removal devices use mechanical action to brush or rub the stain out of the fabric. However, this practice often may lead to discoloration, fabric wear, or other damage to articles such as, but not limited to, clothing. Thus, there is a need to clean stains with pressurized water associated with a laundry washing machine to reduce damage.

SUMMARY

In some embodiments of the invention, for example, a stain removal tool for a laundry washing machine may include a wand positionable between a stowed position and a deployed position relative to a laundry washing machine. The wand may include a water supply head hingedly connected to a water drainage head by a hinge. In some embodiments, when the wand is in the deployed position the water supply head may be hingedly moveable between a closed position and an open position relative to the water drainage head. Further, the water supply head may include one or more nozzles in fluid communication with a water supply line. Further, the water drainage head may be in fluid communication with the one or more nozzles of the water supply head when in the closed position. In various embodiments, the water drainage head may be in fluid communication with one or more outlets.

In some embodiments, the wand may include a through opening when in the closed position between the hinge and at least one of the water supply head or the water drainage head. In various embodiments, the through opening may be defined by one or more L-shaped arms connecting the hinge to at least one of the water drainage head or the water supply head. Further in some embodiments, the wand may include a gasket sealingly engaging the water drainage head with the water supply head when in the closed position. In addition in some embodiments, the water drainage head and the water supply head may be spaced from the hinge by one or more arms. In some embodiments, the water drainage head may include the one or more outlets. In various embodiments, the wand may include one or more downstream drain lines.

In various embodiments, the laundry washing machine with a stain removal tool may include a laundry washing machine having a door defining an opening therein. Further, the opening may include a cover disposed about a wash tub. The laundry washing machine may include a wand positionable between a stowed position and a deployed position relative to the cover. Further, the wand may include a water supply head hingedly connected to a water drainage head by a hinge. Further, when the wand is in the deployed position the water supply head may be hingedly moveable between a closed position and an open position relative to the water drainage head. In some embodiments, the water supply head may include one or more nozzles in fluid communication with a water supply line. In addition in some embodiments, the water drainage head may be in fluid communication with the one or more nozzles of the water supply head when in the closed position. In various embodiments, the water drainage head may be in fluid communication with one or more outlets.

In addition, in some embodiments, one or more arms may connect at least one of the water supply head or the water drainage head to the hinge. Further, the one or more arms may include the one or more outlets of the wand. In various embodiments, the wand may operate at least when the door is open. Further in some embodiments, the water drainage head may include the one or more outlets of the wand and discharge into the wash tub. In various embodiments, the one or more outlets of the wand may be in fluid communication with one or more downstream drain lines. In addition in some embodiments, the wand may further include one or more gaskets defining one or more substantially sealed cavities between the water supply head and the water drainage head when in the closed position. In various embodiments, the wand may further include one or more L-shaped arms connecting at least one of the water supply head or the water drainage head to the hinge, and the one or more L-shaped arms may define a through opening adjacent at least one of the water supply head or the water drainage head when in the closed position.

In some embodiments, the laundry washing machine with a stain removal tool may include a laundry washing machine having a door defining an opening therein. Further, the opening may include a cover disposed about a wash tub. The laundry washing machine may further include a wand positionable between a stowed position and a deployed position relative to the cover. Further, the wand may include a water supply head hingedly connected to a water drainage head by a hinge. Further, when the wand is in the deployed position the water supply head may be hingedly moveable between a closed position and an open position relative to the water drainage head. In some embodiments, the wand may include one or more arms interconnecting the water supply head and the water drainage head to the hinge. In various embodiments, the water supply head may include one or more nozzles in fluid communication with a water supply line. In addition in some embodiments, the water drainage head may be in fluid communication with the one or more nozzles of the water supply head when in the closed position. Further, the water drainage head may be in fluid communication with one or more outlets.

In addition, in some embodiments, the water drainage head may include the one or more outlets of the wand and discharge into the wash tub when in the deployed position. In various embodiments, the wand may include one or more gaskets defining one or more substantially sealed cavities between the water supply head and the water drainage head when in the closed position. Further, the water drainage head may include one or more support members defining one or more openings downstream of the one or more cavities. Further in some embodiments, the one or more arms may include the one or more outlets. In various embodiments, the one or more arms may be L-shaped to define a through opening when in the closed position. In addition in some embodiments, the one or more outlets may be adjacent a front edge of the water drainage head.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques within a top-load residential laundry washing machine such as laundry washing machine 10, such as the type that may be used in single-family or multi-family dwellings, or in other similar applications. However, it will be appreciated that the herein-described techniques may also be used in connection with other types of laundry washing machines in some embodiments. For example, the herein-described techniques may be used in commercial applications in some embodiments. Moreover, the herein-described techniques may be used in connection with other laundry washing machine configurations. For example, a front-load laundry washing machine that includes a front-mounted door in a cabinet or housing that provides access to a horizontally-oriented wash tub housed within the cabinet or housing may be used. Implementation of the herein-described techniques within a front-load laundry washing machine would be well within the abilities of one of ordinary skill in the art having the benefit of the instant disclosure, so the invention is not limited to the top-load implementation discussed further herein.

Figure 1:
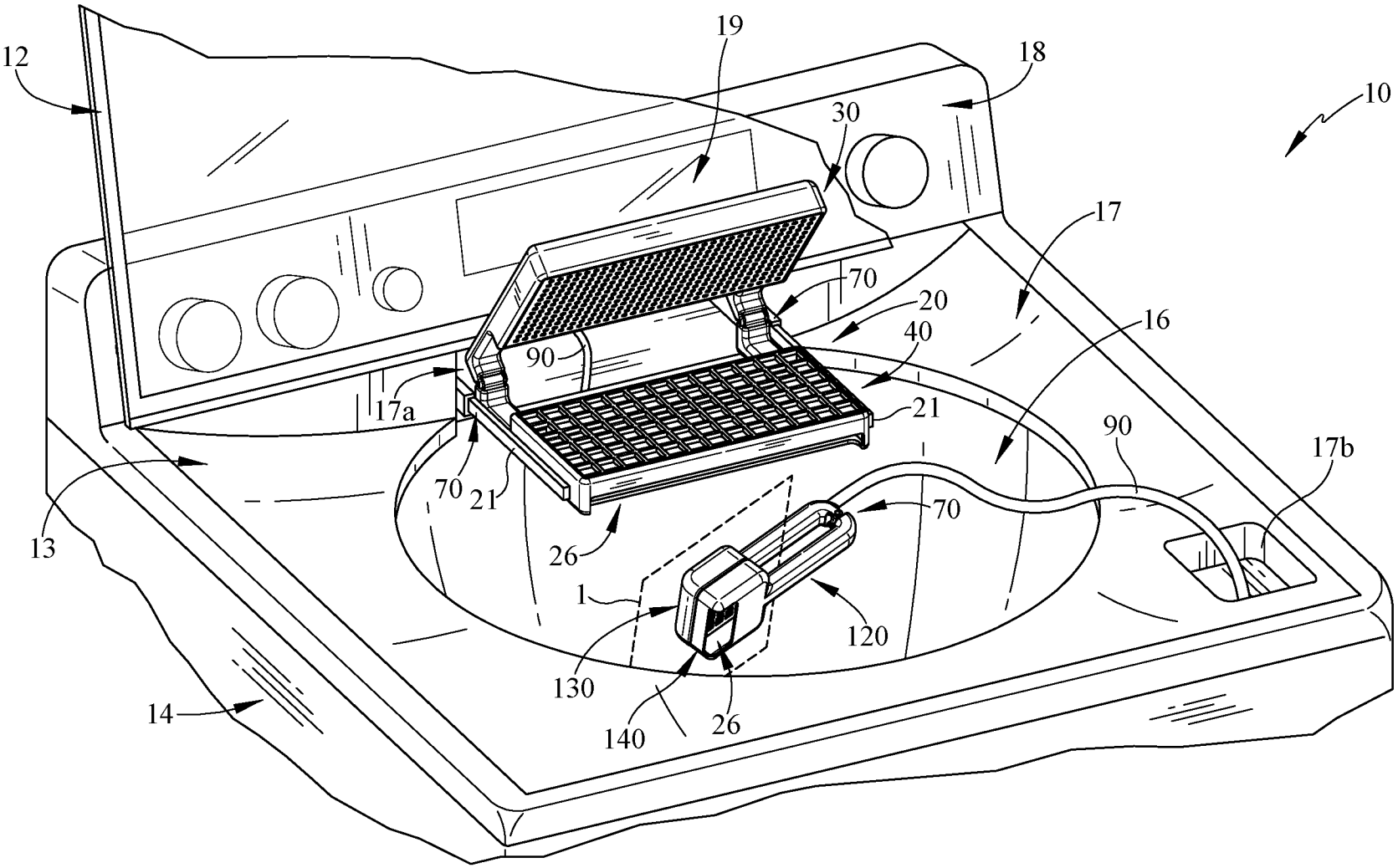
FIG. 1 is an enlarged perspective view of two embodiments of a stain removal tool deployed for use in an embodiment of a laundry washing machine, with portions of the washing machine broken away.

Turning now to the drawings, wherein like numbers denote like parts throughout the several views, FIG. 1 illustrates an example laundry washing machine 10 in which the various technologies and techniques described herein may be implemented. Laundry washing machine 10 is a top-load washing machine, and as such includes a top-mounted door 12 in a cabinet or housing 14 defining an opening 13 that provides access to a vertically-oriented wash tub 16 housed within the cabinet or housing 14. Door 12 is generally hinged along a side or rear edge and is pivotable between the open position illustrated in FIG. 1 and a closed position (not shown). When door 12 is in the opened position, clothes and other washable items may be inserted into and removed from wash tub 16 through the opening 13 in the top of cabinet or housing 14. Control over washing machine 10, or more specifically the stain removal tool 20, by a user is generally managed through a control panel 18 disposed on a backsplash and implementing a user interface 19 for the stain removal tool, and it will be appreciated that in different washing machine designs, control panel 18 may include various types of input and/or output devices, including various knobs, buttons, lights, switches, textual and/or graphical displays, touch screens, etc. through which a user may configure one or more settings and start and stop the stain removal cycle as described herein. For example, the control panel, or portions thereof, may be included with the stain removal tool or adjacent the stain removal tool within the opening of the washing machine. For example in some embodiments, portions of the controls may be accessible when the door is in the open position.

As shown in the Figures, the stain removal tool 20 may be positionable relative to the washing machine 10 between a stowed or un-deployed position (not shown) and a deployed position. Although the embodiments of the stain removal tool 20 are shown to deploy from the stowed position, it should be understood that embodiments of the stain removal tool 20 may be interchangeable with other components of the washing machine 10 when needed. As a result in some embodiments, the swapped out or bypassed component of the washing machine may lose its function while the stain removal tool is connected. Moreover for example, the stain removal tool 20 may be operatively connected to the washing machine 10 when needed. When in the deployed position as shown in FIG. 1, the stain removal tool 20 may be used to remove stains from the article of clothing 1. The article 1 may be a variety of items, not limited to clothing, that may need treated for a stain such as but not limited to backpacks, sheets, towels, rugs, curtains, blankets, toys, etc. It should be understood that the stain removal tool 20 may be operated when in the stowed position and/or in the deployed position in some embodiments. In the deployed position, the stain removal tool may be positionable between an open position and/or closed position. When in the open position FIGS. 1 and 2), the stain removal tool 20 may receive or engage the article of clothing. When in the closed position (FIGS. 3 and 4) the article of clothing 1 may be secured and the stain may be removed or treated via water, pressurized and/or unpressurized, of a variety of temperatures and/or soap. Although in the embodiment shown the stain removal tool 20 is deployed from a recess 17*a* of a cover 17 disposed about the wash tub 16, it should be understood that the stain removal tool 20 may be deployed from a variety of positions and/or orientations relative to the washing machine 10. Further for example, the stain removal tool may be stored outside the compartment or opening 13 defined by the door 12 in the closed position. Moreover for example, another embodiment of the stain removal tool 120 may be temporarily stored within a fixed receptacle 17*b* in the front of the cover 17 or temporarily removed from a drawer. The cover 17 may be a variety of shapes, sizes, and constructions.

As shown in one embodiment, the stain removal tool 20 may be a drawer positioned, manually and/or automatically, between a deployed position and a stowed position in a variety of methods and/or mechanisms. In one embodiment shown in FIGS. 1-4, the stain removal tool 20 slides between the stowed position and the deployed position (FIG. 1) by one or more rails 21 (i.e. horizontal rails). In the deployed position in the one embodiment shown, the stain removal tool 20 and/or outlet 26 may be positioned over the wash tub 16 and can subsequently returned or slid back at least partially into the recess 17*a* of the cover 17 when in the stowed position. Other embodiments may pivot, flip, slide, rotate, etc. or combinations thereof into and/or out of multiple positions in configuring towards the stowed position and/or deployed position. In another embodiment shown that will be discussed in more detail below, the stain removal tool 120 may be handheld and removed from the stowed position to a handheld deployed position (FIG. 1). With the handheld stain removal tool 120 in the deployed position, the handheld stain removal tool 120 may be movable to a variety of positions and/or orientations. For example, the handheld stain removal tool 120 may be at least partially positioned above and/or within the wash tub 16 by the user during the stain removal cycle or process.

Figure 2:
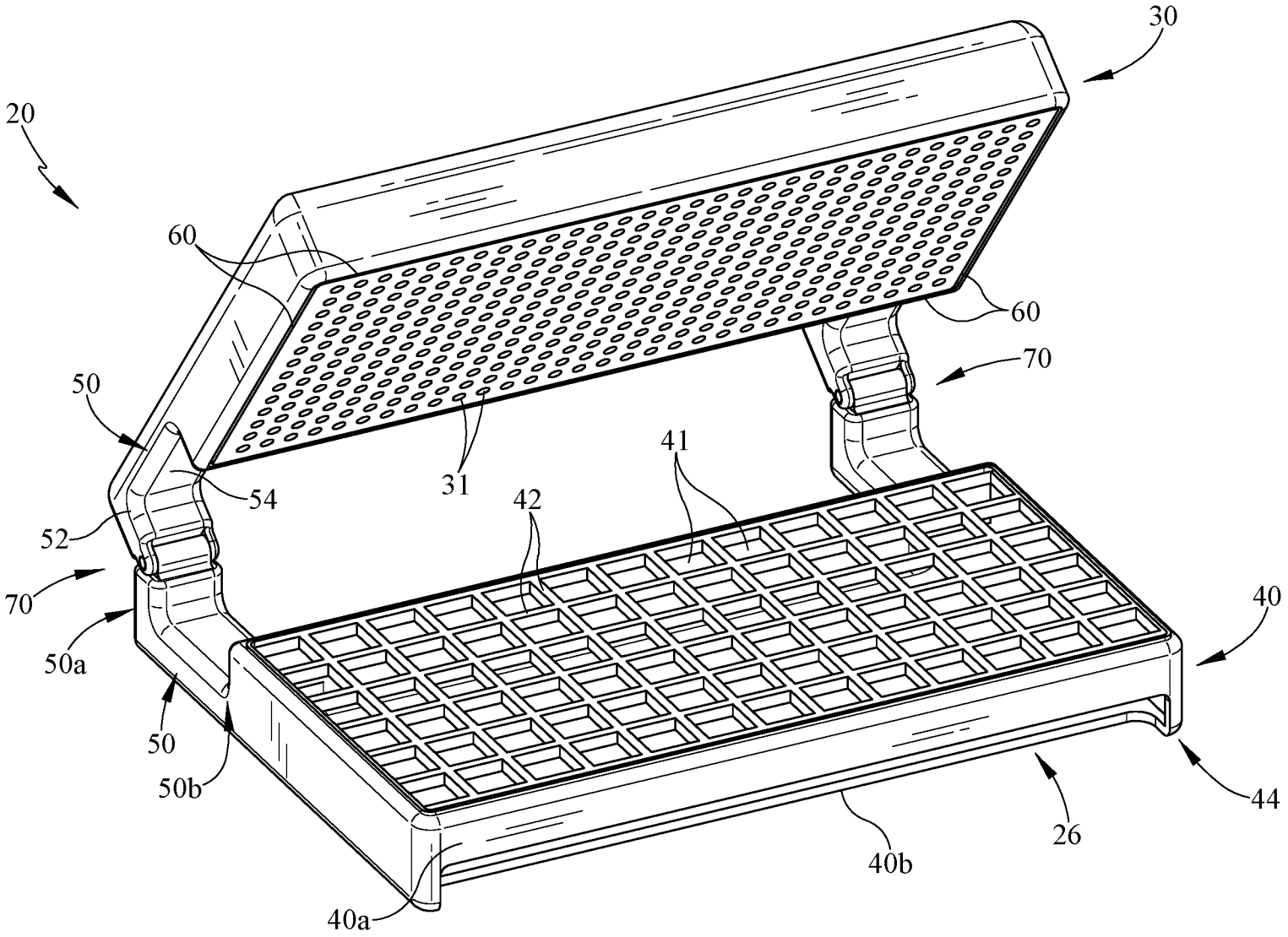
FIG. 2 is a perspective view of the stain removal tool of FIG. 1 in the open position with the slide rails removed.
Figure 3:
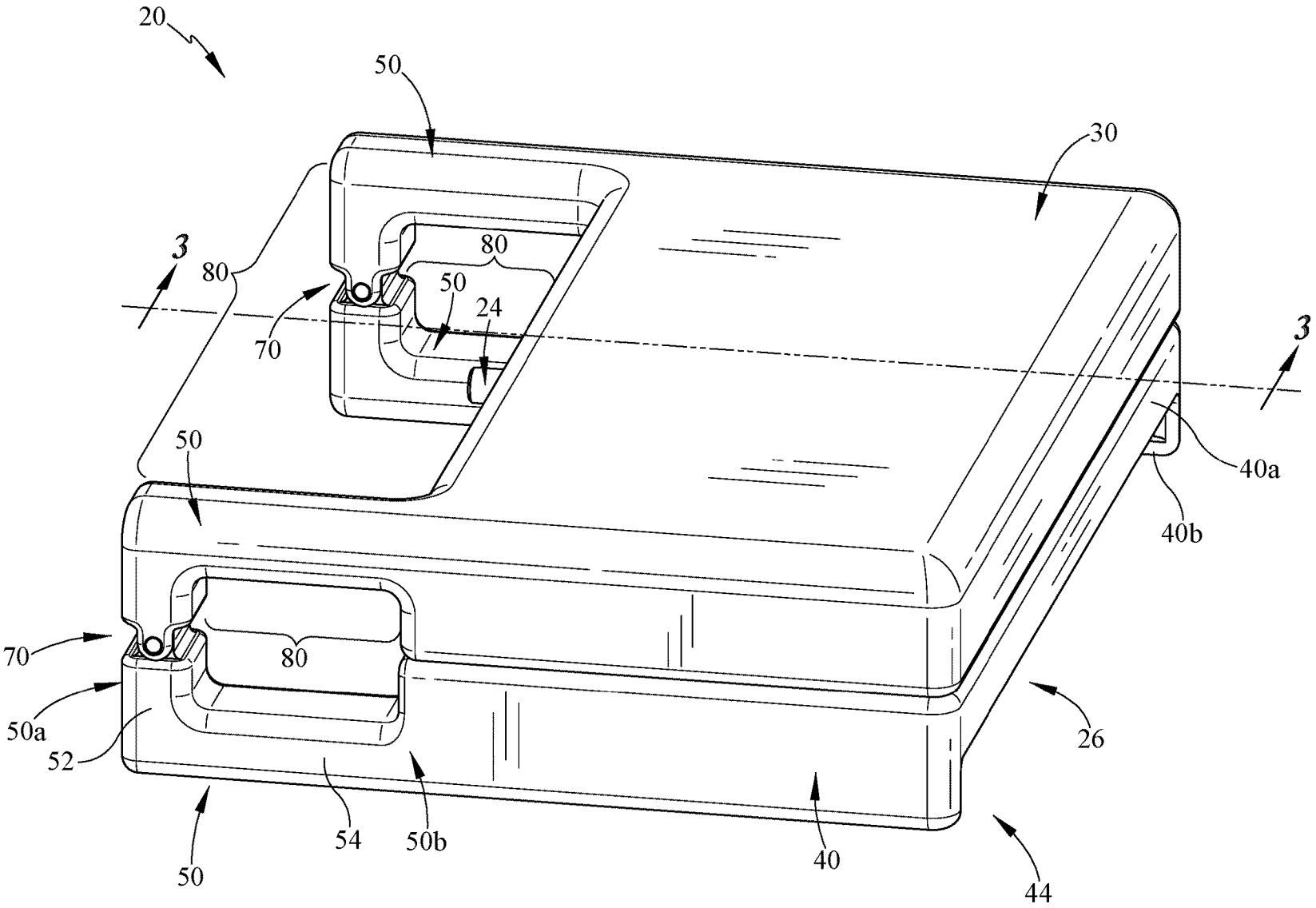
FIG. 3 is a perspective view of the stain removal tool of FIG. 2 in the closed position.

In some embodiments, the stain removal tool 20 may include a water supply head 30 and a water drainage head 40 moveable relative to each other between the closed position (FIGS. 3 and 4) and open position (FIGS. 1 and 2). In the closed position, the water drainage head 40 and the water supply head 30 define one or more cavities 22 to receive a portion of the article of clothing 1. An outer periphery defining one or more cavities 22 may engage the article of clothing 1 to secure its relative position between the heads 30, 40. The water supply head 30 may include one or more nozzles 31 downstream of one or more upstream water inlet channels 23 and/or inlets 24. Although the water inlet channel 23 is shown as within the water supply head 30, it should be understood that a variety of upstream channels or passageways are contemplated. For example, the water inlet channels 23 may be included within the head 30, 40 and/or arms 50. The one or more nozzles may be a variety of sizes, orientations, quantities, and constructions to provide a variety of characteristics of the pressurized water entering the cavity 22 formed between the water supply head 30 and the water drainage head 40 when in the closed position. Water characteristics such as but not limited to speed, directional, spray pattern, volume dispensed, or the like. For example in some embodiments, the nozzles 31 or their output may be changed automatically and/or manually by the user depending on the application (i.e. nozzles interchangeable by a change out of parts or merely adjusted by an object interrupting or not interrupting the flow). Moreover for example, each nozzle may not be the same, pulsate water flow, and/or rotate/move to different positions relative to the stain. In some embodiments, one or more gaskets 60 may be used to create and define a substantially sealed cavity 22 when the stain removal tool 20 is closed. In the one embodiment shown, the gasket 60 is secured against the water supply head 30 and engages and/or disengages from the water drainage head 40. The gasket 60 may surround the outer periphery of the face that includes the nozzles 31 in some embodiments to sealingly engage the water drainage head with the water supply head when in the closed position. Although a gasket 60 may be used in the one embodiment shown, a gasket may not be used. For example, in some embodiments, the water supply head 30 may overlap the periphery of the water drainage head 40 to create a substantially sealed engagement therebetween.

The water drainage head 40 includes one or more openings 41 therein to receive upstream water exiting the nozzles 31 and/or cavity 22. Although the openings 41 are defined by a grid like pattern of support members or web 42, it should be understood that the openings and/or support members may be a variety of shapes, sizes, quantities and constructions. As is shown in one embodiment, the openings 41 are rectangular in shape, larger than the nozzles, and/or may receive the output from one or more nozzles. Moreover for example, the support members 42 defining the openings 41 may be non-linear (i.e. wavy) or other shape to reduce the likelihood of a pattern to form on the clothing article due to the water pressure and/or forces applied thereto when the clothing may be pressed or held against the support members during increased water flow. Similarly, the gasket and/or abutment surfaces of the heads 30, 40 therebetween may include a variety of patterns other than the embodiment shown. Although not shown, one or both of the heads 30, 40 may also include a dispenser or outlet for soap or other additive that may enter into the cavity to assist in removing stains. The stain removal tool 20 may also dispense stain removal soap exterior to the cavity in some embodiments if used. The openings 41 of the water drainage head 40 may be upstream of one or more wastewater outlet channels 25 and outlets 26. Although the wastewater outlet channel 25 is shown as within the water drainage head 40, it should be understood that a variety of downstream channels or passageways are contemplated. For example, the wastewater outlet channels 25 may be included within the head 30, 40 and/or arms 50.

Figure 4:
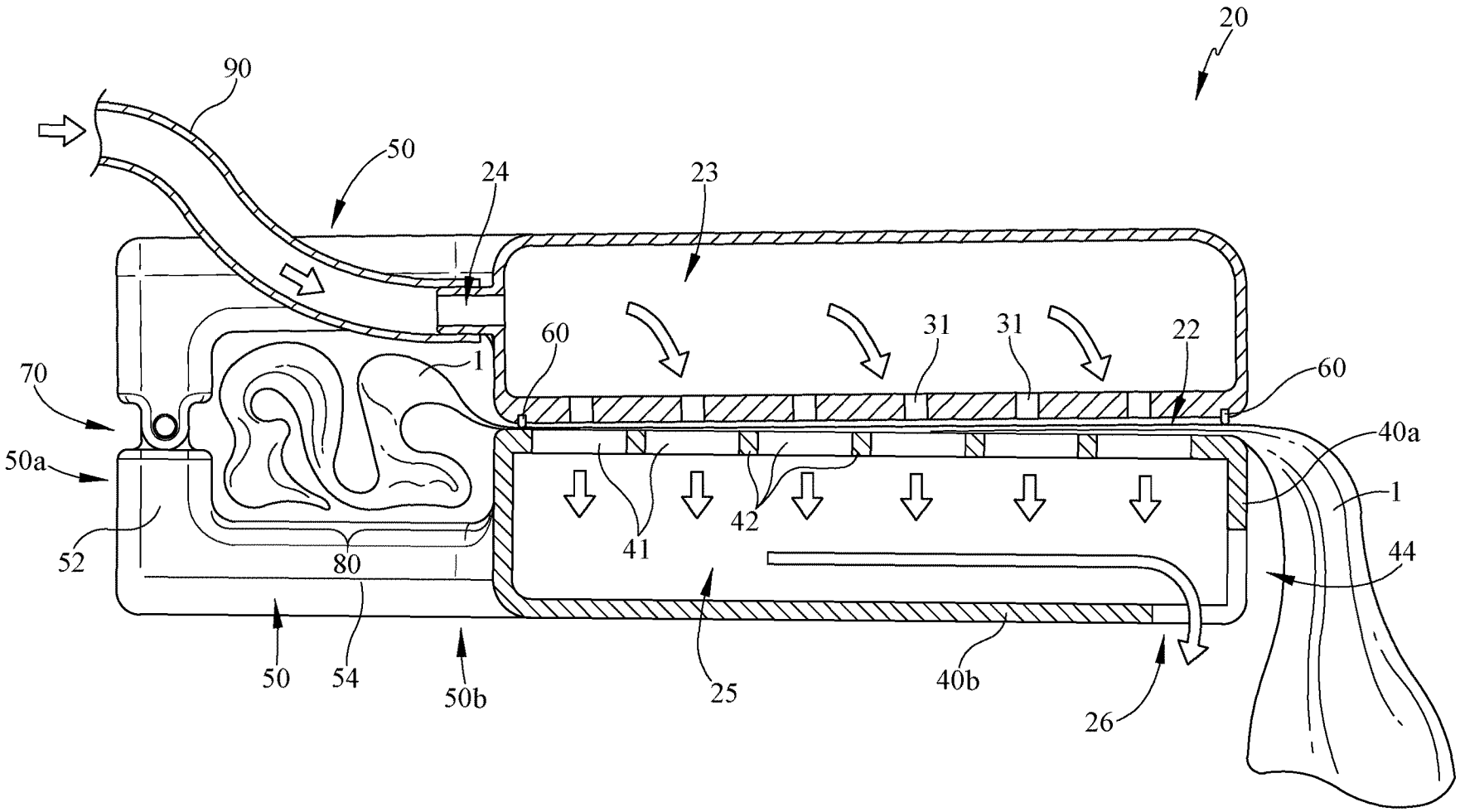
FIG. 4 is a side section view of the stain removal tool of FIG. 3 taken along line 3-3 engaging an article of clothing in the closed position.

In the embodiments shown, the one or more heads 30, 40 may be pivotable relative to each other between an open position and closed position to engage and/or disengage from the article of clothing 1. In some embodiments shown, the heads 30, 40 may include one or more hinges 70 allowing the pivoting of the heads to one or more positions. The water supply head 30 may be hingedly moveable or connected to the water drainage head 40 by a variety of hinge mechanisms allowing pivot. The hinge 70 allows the water supply head 30, if on the upper side of the water drainage head, to pivot upwardly and away from the lower water drainage head 40 to the open position. A hinge 70 may be spaced from the heads 30, 40 by one or more arms 50. The arms 50 may include a proximal end 50*a* adjacent the hinge 70 and a distal end 50*b* adjacent the water supply head 30 and/or the water drainage head 40. The one or more arms 50 and/or the one or more heads 30, 40 may define one or more through openings or cavities 80. The through openings 80 may be in some embodiments as the space between the hinge and/or the heads. In other embodiments, the through opening may extend in areas beyond the extent of the arms, such as above, below, between adjacent sets of arms, lateral to the arms, and/or beyond the outer extent of one or more heads. In the embodiment shown, the through opening 80 may be defined by one or more substantially L-shaped arms, (i.e. opposing arms relative to the hinge) in one embodiment shown. For example, the L-shaped arm may extend only from the water supply head 30 in some embodiments. As is shown in the Figures, the smaller portions 52 of the L-shaped arms extend substantially in the opposite directions adjacent the hinge and/or proximal end 50*a*, then the larger portions 54 extend in the same transverse direction towards their respective head 30, 40 and/or distal end 50*b*. As shown in FIGS. 1 and 4, the one or more through openings 80 between the hinged connection and the heads may allow the excess material of the article of clothing 1 to be temporarily retained to allow the cavity 22 defined by the heads 30, 40 to reach an area the article of clothing that contains the stain therein. Moreover as shown in the embodiment in FIG. 3, the through opening may not be restricted by the hinge 70 connection along the entire pivot axis, since the space or through opening 80 between two adjacent pivoting sets of arms and/or hinges may provide additional unrestricted capacity not limited by the hinge connection for the excess article of clothing to collect.

Figure 5:
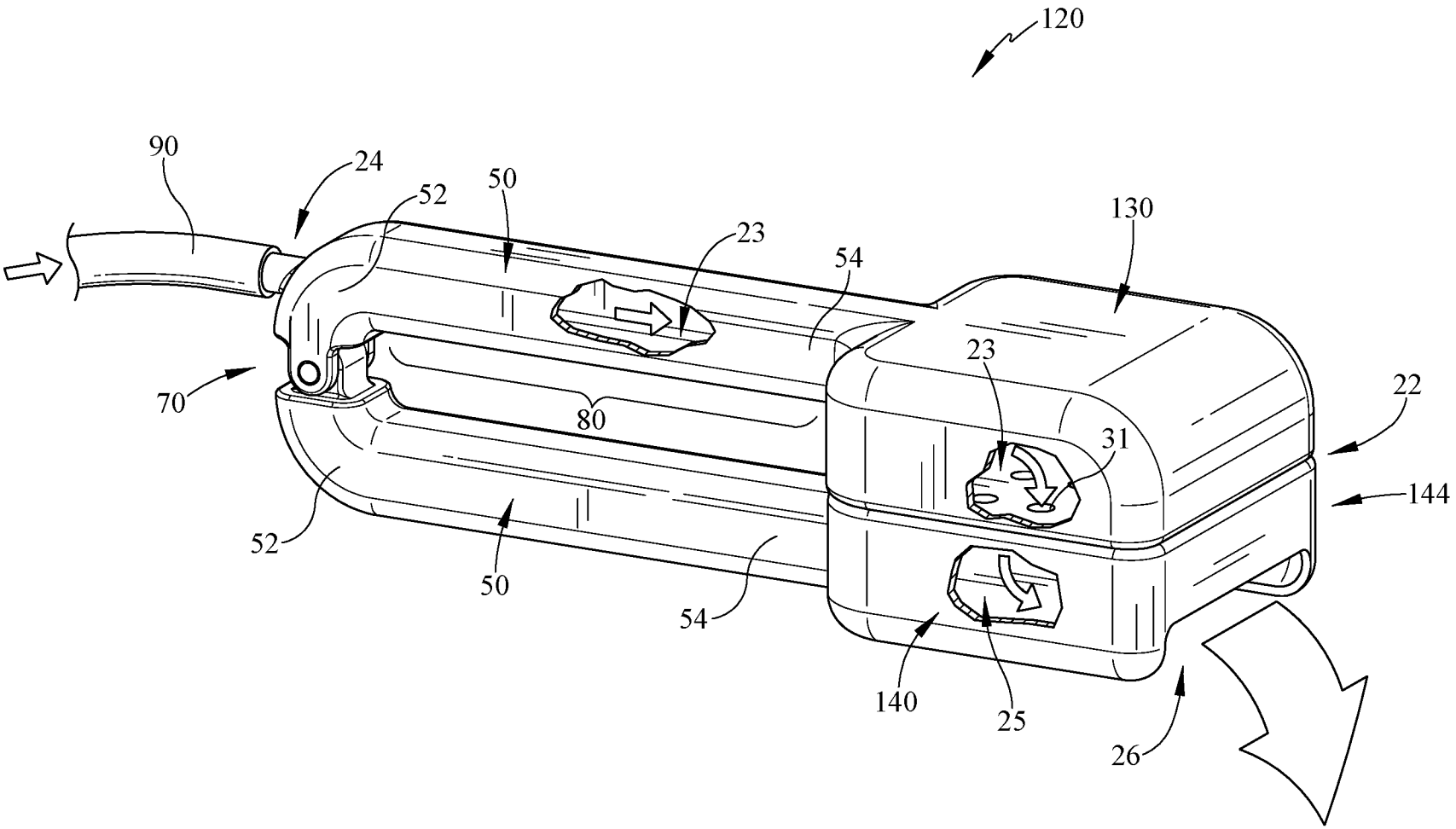
FIG. 5 is a perspective view of the other stain removal tool of FIG. 1 in the closed position illustrating a water supply line in fluid communication with the handle.
Figure 6:
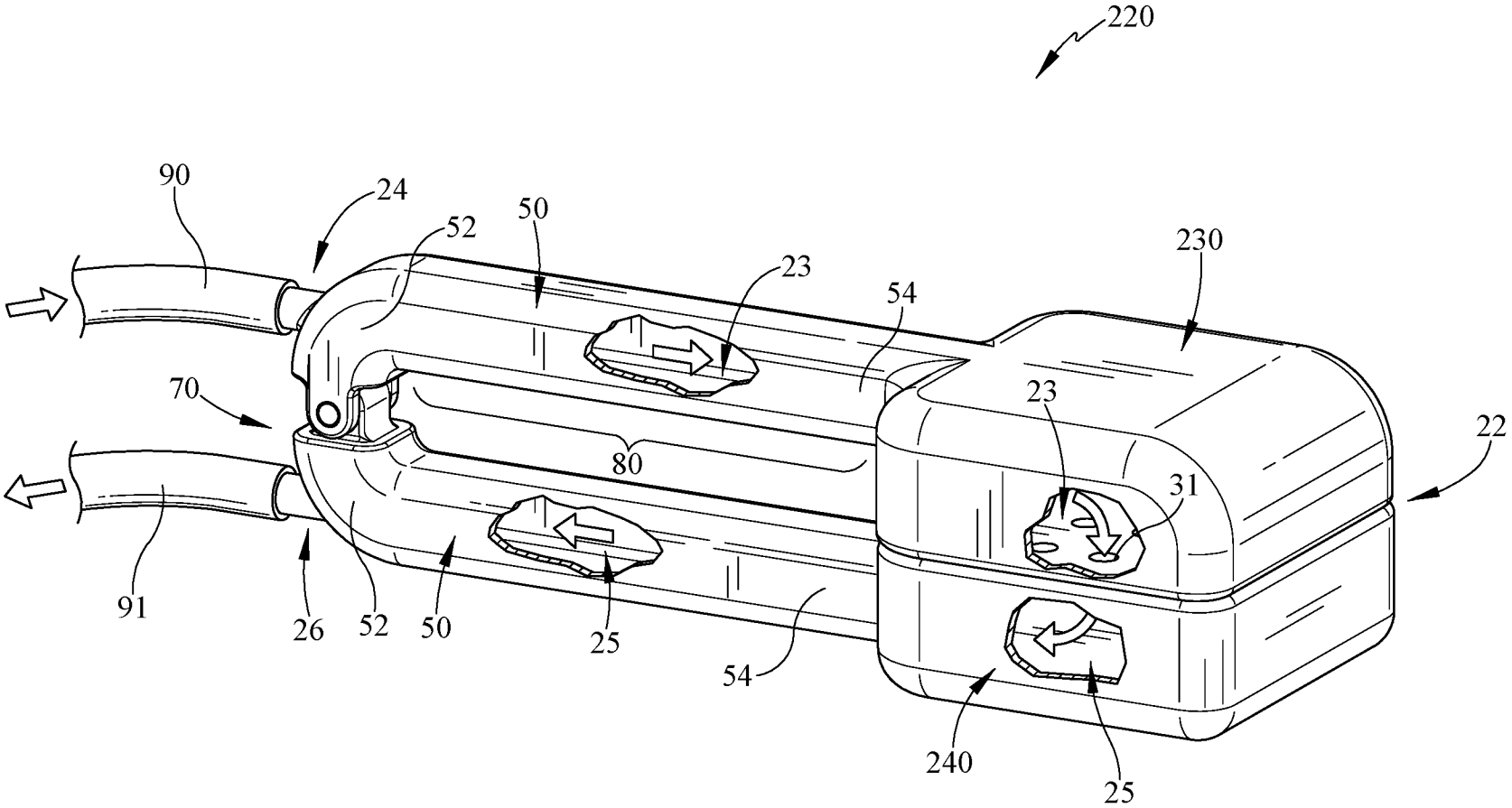
FIG. 6 is a perspective view of another embodiment of the stain removal tool of FIG. 5 illustrating a water supply line and a drain line in fluid communication with the handle.

The stain removal tool 20 may include one or more water inlets 24 and/or one or more wastewater outlets 26 to allow water to be in fluid communication with the article of clothing 1. One or more water inlets 24 of the stain removal tool 20 may be in fluid communication with one or more water supply lines 90 of the washing machine 10. The water inlets 24 of the stain removal tool 20 may allow water to flow through one or more water inlet channels 23 of the stain removal tool 20 to communicate with the nozzles 31 and/or cavity 22. In the embodiment shown, the water inlet 24 is positioned adjacent or with the water supply head 30 with the one or more channels 23 within the water supply head connecting with the nozzles 31. In some stain removal tool embodiments 120, 220 as shown in FIGS. 1, 5, and 6, one or more arms 50 may be included with one or more inlets 24 and/or water inlet channels 23 to transfer at least water to the nozzles 31. The stain removal tool 220 includes one or more water inlet channels 23 through the arm 50 and water supply head 230 upstream from the nozzles 31. In some embodiments one or more drain lines 91 may be included downstream of the drainage head. One embodiment of the drain line 91 is shown in the stain removal tool 220 embodiment of FIG. 6. In the one embodiment shown in FIG. 6, the drain line 91 is downstream of the outlet 26 positioned in the handle or arm 50 of the stain removal tool 220. The outlet 26 is positioned adjacent the hinge 70 and is in fluid communication with a wastewater outlet channel 25 within the arm 50 to the water drainage head 240. The drain lines 91 may be in fluid communication with the wash basket or outer tub and/or directly to a discharge drain line from the machine. In some embodiments, the drain line 91 discharges the wastewater into the wash tub 16 thereby reducing contact with the user. If one or more drain lines 91 are used, the one or more outlets 26 may be in fluid communication with existing and/or dedicated drain lines of the washing machine 10. Although not shown, a drain line may be connected to an outlet 26 of the water drainage head, instead of the arm 50 as is shown. Although not shown, a vacuum may recirculate water back through the water supply head and/or pump the wastewater from the water drainage head. In the stain removal tool 20, 120 embodiments shown in FIGS. 1-5, the water drainage head 40, 140 include one or more outlets 26. The outlets 26 in the stain removal tool 20 embodiment may be at the front edge 44 of the water drainage head 40 and include a portion of the front 40*a* and/or bottom 40*b* of the head. The outlet 26 may allow the wastewater to pour or free drain or flow via gravity into the wash tub 16. In various embodiments, when the stain removal tool 20, 120 is deployed over and/or within the wash tub 16, the outlet 26 may also be positioned over and/or within the wash tub 16 and allows the soiled waste water to discharge into the wash tub. With the discharge of wastewater at the front edge 44, the user may be able to visually evaluate the discharge wastewater to see the progress of the stain removal based on, but not limited to, at least the reduction of soiled characteristics of the water and/or soap suds exiting the outlet 26 of the water drainage head 40.

Several handheld embodiments of the stain removal tool 120, 220 are shown in FIGS. 1, 5, and 6 and may be used alone or in combination (FIG. 1) with other embodiments such as the stain removal tool 20. In the one embodiment shown in FIGS. 1 and 5 of the handheld stain removal tool 120, one or more hinges 70 interconnect two spaced apart arms 50 with their respective water drainage head 140 and the water supply head 130. As shown in FIG. 1, the handheld stain removal tool is deployed from a receptacle 17*b* within the cover 17 and is illustrated engaging the article of clothing 1 in the closed position over the opening of the wash tub 16. The receptacle may be but is not limited to a drawer, shelf, or the like. A portion of the article of clothing 1 may be received as shown within the through opening 80 defined by the arms. If used, a gasket 60 may be positioned between each head 130, 140 in some embodiments. With the discharge of waste water at the front edge 144 of the water drainage head 140 in FIGS. 1 and 5, the user may be able to visually evaluate the discharge water to see the progress of the stain removal based on, but not limited to, at least the reduction of soiled characteristics of the water and/or soap suds exiting the outlet 26 of the water drainage head 140. In the stain removal tool 220 embodiment shown in FIG. 6, a drain line 91 may be used to discharge the wastewater into the wash tub through an arm 50 of the handle. Although the embodiment of the stain removal tool 20 as shown in FIG. 1 does not have a drain line, it should be understood that a drain line may be in fluid communication with the stain removal tool in some embodiments.

In use, the embodiment of the stain removal tool 20 shown in FIG. 1 may be slid to the operating or deployed position from another location or stowed position (not shown) relative to the laundry washing machine 10. Soap and stain remover may be applied to the stain on the garment manually by hand, or in some embodiments the device may dispense soap automatically. With the tool open, the tool is clamped around the stain within the article of clothing, and if needed a portion of the article of clothing may be retained in the one or more through openings 80 (FIG. 4) to position the stain within the cavity 22 defined by the heads 30, 40. With the stain removal tool 20 deployed, the user may activate the pressurized water by the control panel 18 or switch when the stain removal tool is in the closed position. In some embodiments, the door 12 of the laundry washing machine 10 may need to be closed such that the stain removal tool 20 may allow water to flow therethrough. Further, a lid lock function may be used to prevent the lid from being opened when hot water and/or a temperature or range of temperature is selected or used. Although the control panel 18 may be outside the door 12 as shown, it should be understood that the controls may be adjacent to, i.e. within the door or cover, or combined with the stain removal tool. For example, the stain removal tool may have one or more activating triggers. With the door closed, a temperature range or value of the water may be available since the user is out of contact with the wash tub opening. Alternatively, another range of water temperature may be available if the lid is in an open position. In some embodiments such as with stain removal tools 120, 220, this temperature range when the lid is open may be lower than the temperature available when the door is closed. In the embodiment of FIG. 1, a drain line is not used. However, an embodiment may include a drain line reducing the likelihood of contact with the user. The outlet 26 adjacent the front edge 44 of the water drainage head 40 may direct wastewater into the wash tub. The user may open the stain removal tool 20 to see the progress of the stains removal, reapply soap, and/or readjust the placement of the article of clothing within the clamped heads before closing and repeating the pressurized supply of water towards the stain. Although not shown, the embodiments of the stain removal tool may have one or more portions being see-through to observe the stain's removal, wastewater, soap, or other characteristics during the process. For example, the water supply head may be transparent. Upon the stain's removal, duration of water, soak duration, and/or one or more cycles of pressurized water, the stain removal tool may be opened and the article of clothing may be placed within the wash basket for a subsequent wash cycle if desired. Further in the one embodiment, the stain removal tool 20 may be returned or slid to its stowed position within the cover.

In use, the handheld or wand type stain removal tool 120, 220 may be stored in the stowed position in a variety of receptacles 17*b* (i.e. within the cover 17) in the laundry washing machine 10. Soap and stain remover may be applied to the stain on the garment manually by hand, or in some embodiments the device may dispense soap automatically. With the device open, the device is clamped around the stain within the article of clothing, and if needed a portion of the article of clothing may be retained in the through opening 80 to position the stain within the cavity defined by the heads. With the stain removal tool head over and/or within the wash basket by the user, the user may activate the pressurized water by the control panel or switch when the stain removal tool is in the closed position. Although the control panel may be outside the lid as shown, it should be understood that the controls may be adjacent to, i.e. within the lid or cover, or combined with the stain removal tool. For example, the stain removal tool may have one or more activating triggers. It should be understood that the stain removal tool could be operated without the user holding and/or with the lid closed in some embodiments. For example, the stain removal tool have a hook or other temporary holding mechanism to hang the stain removal tool adjacent to or within the wash tub 16 during stain removal. The temperature range or value may be limited in the free draining embodiment of FIG. 1 when wastewater is draining above or within the wash tub 16. In the embodiment of FIG. 6, the drain line 19 may direct wastewater into the wash tub reducing the likelihood of contact with the user. The user may open the stain removal tool 120, 220 to see the progress of the stains removal, reapply soap, and/or readjust the placement of the article of clothing within the clamped heads before closing and repeating the pressurized supply of water towards the stain. Although not shown, the embodiments of the stain removal tool may have one or more portions being see-through to observe the stain's removal, wastewater, soap, or other characteristics during the process. For example, the water supply head may be transparent. Upon the stain's removal, duration of water, soak duration, and/or one or more cycles of pressurized water, the stain removal tool may be opened and the article of clothing may be placed within the wash basket for a subsequent wash cycle if desired. Further, the stain removal tool may be returned to its stowed position within the receptacle.

It some embodiments, the stain removal tool may also include soap dispensing. The soap may be used for the stain removal tool and/or for dispensing soap into the wash tub. Although not shown, for example the slide out drawer stain removal tool 20 may include a soap receptacle for the user to add quantities of soap for the wash tub 16 and/or stain removal. The stain removal tool 20 may include a water supply line used for each of the soap dispensing and the stain removal function, or a separate water lines may be used in some embodiments. In some embodiments, the stain removal tool 20 may be interchanged with one or more parts of a soap dispensing tray when desired to operate the stain removal tool. This may remove the function of the soap dispensing tray until the swappable parts are returned. It is further contemplated that inside the door 12 may be areas to hold a stain removal stick and/or soap for use with the stain removal tool.

In some embodiments, the stain removal tool may include one or more lights therein. The lights may aid the user to observe the stain removal process such as before, during, and/or after water flow. For example, the lights may turn on when the tool is in one or more of the open position, closed position, or deployed position.

In some embodiments, several locking mechanisms may be used to secure the stain removal tool in the closed position when engage the article of clothing. For example, a toggle clamp or vice-grip style lever may be used. Another example, the stain removal tool may magnetically hold the heads together when in the closed position. In some embodiments, such as the handheld wand, the user may clamp the device together by squeezing and/or holding the two arms of the handle together. It should be understood that a variety of latches or temporary retention device may be used in the embodiments. Further, release assists may be used to aid the user to position the stain removal tool into the open position.

In operation, embodiments of the stain removal tool may be operated by one or more control panels 18. As is shown in the embodiments, a control panel 18 may be outside the door 12. However, the control panels may be inside and/or outside the door. In use, the one or more water temperatures, one or more durations of water flow, and/or one or more amounts of soap may be selected by the user. Therefore, in some embodiments, a timer may be used to determine the amount of water dispensed into the cavity 22 of the heads 30, 40. The duration, soap, and/or temperature may be preset, determined upon placing the article of clothing within the stain removal tool, or predetermined. For example, the washing machine and/or stain removal tool may include a slide/knob mechanism to adjust the water temperature or duration. Also, preprogrammed cycles or modes may also be used such as for specific stains such as grass, blood, oil, etc and/or the type of the article such as cotton, polyester, silk, denim, wool, and/or percentages of each material. These cycles may automatically provide the water temperature mixture, duration, programmed spray/soak sequence, and/or select for certain stain/cleaner types, enzymes, or the like.

It should be understood that in some embodiments, laundry washing machine 10 may be, in whole or in part, under the control of a controller (not shown) that receives inputs from a number of components and drives a number of components in response thereto. Controller may, for example, include one or more processors and a memory (not shown) within which may be stored program code for execution by the one or more processors. The memory may be embedded in controller, but may also be considered to include volatile and/or non-volatile memories, cache memories, flash memories, programmable read-only memories, read-only memories, etc., as well as memory storage physically located elsewhere from controller, e.g., in a mass storage device or on a remote computer interfaced with a controller.

A controller may be interfaced with various components, including the aforementioned water supply or drainage lines, soap dispensing, temperature sensor (not shown), and flow sensor (not shown), timer, or the like. In addition, controller may be coupled to a user interface 19 including various input/output devices such as knobs, dials, sliders, switches, buttons, lights, textual and/or graphics displays, touch screen displays, speakers, image capture devices, microphones, etc. for receiving input from and communicating with a user, e.g., as may be disposed in a control panel 18. In some embodiments, a controller may also be coupled to one or more network interfaces, e.g., for interfacing with external devices via wired and/or wireless networks such as Ethernet, Bluetooth, NFC, cellular, and other suitable networks. Additional components may also be interfaced with a controller, as will be appreciated by those of ordinary skill having the benefit of the instant disclosure. Moreover, in some embodiments, at least a portion of controller may be implemented externally from a laundry washing machine, e.g., within a mobile device, a cloud computing environment, etc., such that at least a portion of the functionality described herein is implemented within the portion of the controller that is externally implemented.

In some embodiments, a controller may operate under the control of an operating system and may execute or otherwise rely upon various computer software applications, components, programs, objects, modules, data structures, etc. In addition, controller may also incorporate hardware logic to implement some or all of the functionality disclosed herein. Further, in some embodiments, the sequences of operations performed by controller to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

For example, the soap, duration, and/or temperature of the supplying water to the stain removal tool may be manually and/or automatically started and/or ended by the laundry washing machine. The user may manually start and/or end the water cycle to the stain removal tool. For example, an on and/or off switch may be used by the user to operate the water cycle. In other embodiments the water/temperature may be automated. For example, the mere presence of an object within the closed stain removal tool may start a stain removal cycle and/or lack thereof or lid opening may stop a stain removal cycle.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A stain removal tool for a laundry washing machine comprising:

a handheld wand positionable between a stowed position affixed to the laundry washing machine and a deployed position out of said stowed position and separated from the laundry washing machine to be handheld by the user, and wherein said wand is in fluid communication with a water supply line from the laundry washing machine in said deployed position;

wherein said wand includes a water supply head hingedly connected to a water drainage head by a hinge, wherein when said wand is in said deployed position said water supply head is hingedly moveable between a closed position and an open position relative to said water drainage head;

said water supply head defines a water inlet channel therein, wherein said water supply head includes one or more nozzles in fluid communication through said water inlet channel to said water supply line that is connected to a water inlet;

said water drainage head is in fluid communication with said one or more nozzles of said water supply head when in said closed position, and wherein said water drainage head includes one or more outlets; and wherein said water drainage head defines a water outlet channel therein, wherein said water drainage head includes said one or more outlets positioned in a front edge of said water drainage head adjacent a front edge of said water supply head in communication with said water outlet channel, such that fluid flows laterally from said water inlet, through said water inlet channel, through said plurality of nozzles and into said water outlet channel, laterally through said water outlet channel and out said one or more outlets adjacent said front edge of said water drainage head.

2. The stain removal tool of claim 1 wherein said wand includes a through opening when in said closed position between said hinge and at least one of said water supply head or said water drainage head.

3. The stain removal tool of claim 2 wherein said through opening is defined by one or more L-shaped arms connecting said hinge to at least one of said water drainage head or said water supply head.

4. The stain removal tool of claim 1 wherein said wand includes a gasket sealingly engaging said water drainage head with said water supply head when in said closed position.

5. The stain removal tool of claim 1 wherein said water drainage head and said water supply head are spaced from said hinge by one or more arms.

6. A laundry washing machine with a stain removal tool comprising:

a door defining an opening surrounded by a cover to a wash tub therein, wherein when said door is in an open position said opening to said wash tub and said cover is accessible to the user;

a handheld wand positionable between a stowed position in said cover and a deployed position relative to said cover, when in said deployed position said wand is separated from said cover and in fluid communication with said laundry washing machine;

wherein said wand includes a water supply head hingedly connected to a water drainage head by a hinge, wherein when said wand is in said deployed position said water supply head is hingedly moveable between a closed position and an open position relative to said water drainage head;

said water supply head includes one or more nozzles in fluid communication with a water supply line and a water inlet of said water supply head;

wherein a water outlet channel defined by said water drainage head is in fluid communication with said one or more nozzles of said water supply head when in said closed position, and wherein said water outlet channel of said water drainage head is in fluid communication with one or more outlets;

wherein said water inlet of said water supply head is spaced away from said one or more outlets of said water drainage head in a horizontal direction with said one or more nozzles laterally positioned therebetween; and wherein said one or more nozzles are positioned rearward of said one or more outlets adjacent a front edge of said water drainage head allowing fluid to laterally flow through said water outlet channel of said water drainage head and out said one or more outlets adjacent said front edge of said water drainage head.

7. The laundry washing machine of claim 6 further comprising one or more arms connecting at least one of said water supply head or said water drainage head to said hinge.

8. The laundry washing machine of claim 6 wherein said wand operates at least when said door is open.

9. The laundry washing machine of claim 6 wherein said one or more outlets discharge directly through said drainage head and discharges into said wash tub.

10. The laundry washing machine of claim 6 wherein said wand further includes one or more gaskets defining one or more substantially sealed cavities between said water supply head and said water drainage head when in said closed position.

11. The laundry washing machine of claim 6 wherein said wand further includes one or more L-shaped arms connecting at least one of said water supply head or said water drainage head to said hinge, and said one or more L-shaped arms defines a through opening adjacent at least one of said water supply head or said water drainage head when in said closed position.

12. A laundry washing machine with a stain removal tool comprising:

a door defining an opening surrounded by a cover to a wash tub therein, wherein when said door is in an open position said opening to said wash tub and said cover is accessible to the user;

a handheld wand positionable between a stowed position in said cover and a deployed position relative to said cover, when in said deployed position said wand is separated from said cover and in fluid communication with said laundry washing machine;

wherein said wand includes a water supply head hingedly connected to a water drainage head by a hinge, wherein when said wand is in said deployed position said water supply head is hingedly moveable between a closed position and an open position relative to said water drainage head;

wherein said wand includes one or more arms interconnecting said water supply head and said water drainage head to said hinge;

said water supply head includes one or more nozzles in fluid communication with a water supply line and said water drainage head includes one or more openings defined by one or more support structures, and wherein said water supply line couples to a water inlet of said water supply head adjacent a back edge of said arm; and said one or more openings of said water drainage head is in fluid communication with said one or more nozzles of said water supply head when in said closed position, and wherein said water drainage head is in fluid communication with one or more outlets of said water drainage head adjacent a front edge of said water drainage head at an opposite end of said hinge to discharge into said wash tub when in said deployed position, and wherein fluid flows laterally from said water inlet adjacent said back edge of said arm towards said one or more outlets adjacent said front edge of said water drainage head through said one or more nozzles and said one or more openings, wherein said one or more openings are positioned laterally away from said front edge of the water drainage head, allowing fluid to flow laterally within a water outlet channel defined by said water drainage head and out said one or more outlets adjacent said front edge.

13. The laundry washing machine of claim 12 wherein said wand includes one or more gaskets defining one or more substantially sealed cavities between said water supply head and said water drainage head when in said closed position.

14. The laundry washing machine of claim 12 wherein said one or more arms are L-shaped to define a through opening when in said closed position.

* * * * *